US010069264B2

(12) United States Patent
Zhou

(10) Patent No.: US 10,069,264 B2
(45) Date of Patent: Sep. 4, 2018

(54) CONVERTER FOR SWITCHING CONTROL SIGNALS

(71) Applicant: HANK ELECTRONICS CO.,LTD, Shenzhen, Guangdong (CN)

(72) Inventor: Yuchun Zhou, Guangdong (CN)

(73) Assignee: HANK ELECTRONICS CO., LTD, Shenzhen, Guangdong (CN)

( * ) Notice: Subject to any disclaimer, the term of this patent is extended or adjusted under 35 U.S.C. 154(b) by 384 days.

(21) Appl. No.: 14/969,692

(22) Filed: Dec. 15, 2015

(65) Prior Publication Data

US 2016/0104989 A1 Apr. 14, 2016

(51) Int. Cl.
*H01R 29/00* (2006.01)
*H01R 31/06* (2006.01)

(52) U.S. Cl.
CPC ..... *H01R 29/00* (2013.01); *H01R 31/065* (2013.01)

(58) Field of Classification Search
CPC ..... H01R 29/00; H01R 31/065
See application file for complete search history.

(56) References Cited

U.S. PATENT DOCUMENTS

2013/0250171 A1* 9/2013 Francis ..... H04N 5/44 348/461
2014/0240593 A1* 8/2014 Tsinberg ..... H04N 5/4401 348/474

* cited by examiner

*Primary Examiner* — Michael Teitelbaum

(57) ABSTRACT

A converter for switching control signals is disclosed to solve the technical problem that existing technologies are unable to switch between two control signals. The converter includes an interface male connected with an equipment which is controlled by a first control signal; an interface socket connected with an equipment which is controlled by a second signal; an interface female connected with cables which are adapted for respectively transmitting the first control signal and the second control signal; a switch which switches between the first control signal and the second control signal; and a substrate connected with the interface male, the interface socket, the interface female and the switch, wherein according to a switching position of the switch, the substrate controls the first control signal or the second control signal in the cables connected with the interface female to correspondingly switch to the interface male or the interface socket for outputting.

3 Claims, 4 Drawing Sheets

CONVERTER FOR SWITCHING CONTROL SIGNALS

BACKGROUND OF THE PRESENT INVENTION

1. Field of Invention

The present invention relates to a converter field, and more particularly to a converter for switching control signals.

2. Description of Related Arts

CEC (consumer electronics control) signals are control signals which are capable of controlling HDMI (High Definition Multimedia Interface) digital products. CEC signals are transmitted to users via cables such as HDMI cables for controlling high definition devices such as blu-ray DVDs.

In addition, besides the above CEC signals, control signals further include infrared control signals and audio control signals. These control signals are also able to be transmitted to users via HDMI cables. However, in existing technologies, take CEC signals as examples, only exist interface units or converters adapted for receiving the CEC signals which are transmitted in HDMI cables and applying the CEC signals to equipments. If infrared signals or other control signals are transmitted in HDMI cables, the infrared signals are unable to be received, sent and applied to corresponding equipments.

SUMMARY OF THE PRESENT INVENTION

An object of the present invention is to provide a converter for switching control signals to convenient for switching between two kinds of control signals.

In order to accomplish the above object, the present invention adopts a technical solution as follows.

A converter for switching control signals comprises:

an interface male connected with an equipment which is controlled by a first control signal;

an interface socket connected with an equipment which is controlled by a second signal;

an interface female connected with cables which are adapted for respectively transmitting the first control signal and the second control signal;

a switch which switches between the first control signal and the second control signal; and a substrate connected with the interface male, the interface socket, the interface female and the switch, wherein according to a switching position of the switch, the substrate controls the first control signal or the second control signal in the cables connected with the interface female to correspondingly switch to the interface male or the interface socket for outputting.

Furthermore, the converter further comprises a casing wrapping around the substrate.

Specially, a male opening corresponding to the interface male is provided on the casing, a portion of the interface male, connected with the equipment which is controlled by the first control signal, is exposed by the male opening;

a switch opening corresponding to the switch is provided on the casing, a portion of the switch for a user to toggle is exposed by the switch opening;

a socket opening corresponding to the interface socket is provided on the casing and the interface socket is connected with the equipment which is controlled by the second control signal by the socket opening; and a female opening corresponding to the interface female is provided on the casing, the interface female is connected with the cables adapted for respectively transmitting the first control signal and the second control signal by the female opening.

Specially, the interface male, connected with the equipment which is controlled by the first control signal, is a HDMI (high definition multimedia interface) male connected with an equipment which is controlled by a CEC (consumer electronics control) signal;

the interface socket, connected with the equipment which is controlled by the second control signal, is an infrared receiving and sending socket connected with an equipment which is controlled by an infrared control signal; and the interface female, connected with the cables adapted for respectively transmitting the first control signal and the second control signal, is an HDMI female connected with HDMI cables adapted for respectively transmitting the CEC signal and the infrared control signal.

In the technical solution of the present invention, the substrate is able to control a switching between the first control signal and the second control signal via the switch for outputting the first control signal or the second control signal respectively corresponding to the interface male or the interface socket. Therefore, the present invention solves the technical problem that the prior art is only able to receive and apply a control signal but not able to switch between two control signals, thereby obtaining the technical effect that the present invention is able to switch between two control signals for further transmitting and applying more first control signals and second control signals.

These and other objectives, features, and advantages of the present invention will become apparent from the following detailed description, the accompanying drawings, and the appended claims.

DRAWING REFERENCES

1: switch; 2: interface socket; 3: substrate; 4: interface male; 5: interface female; 6: casing; 10: converter; 11: switch opening; 21: socket opening; 41: male opening; 51: female opening.

DETAILED DESCRIPTION OF THE PREFERRED EMBODIMENT

Figure 1:
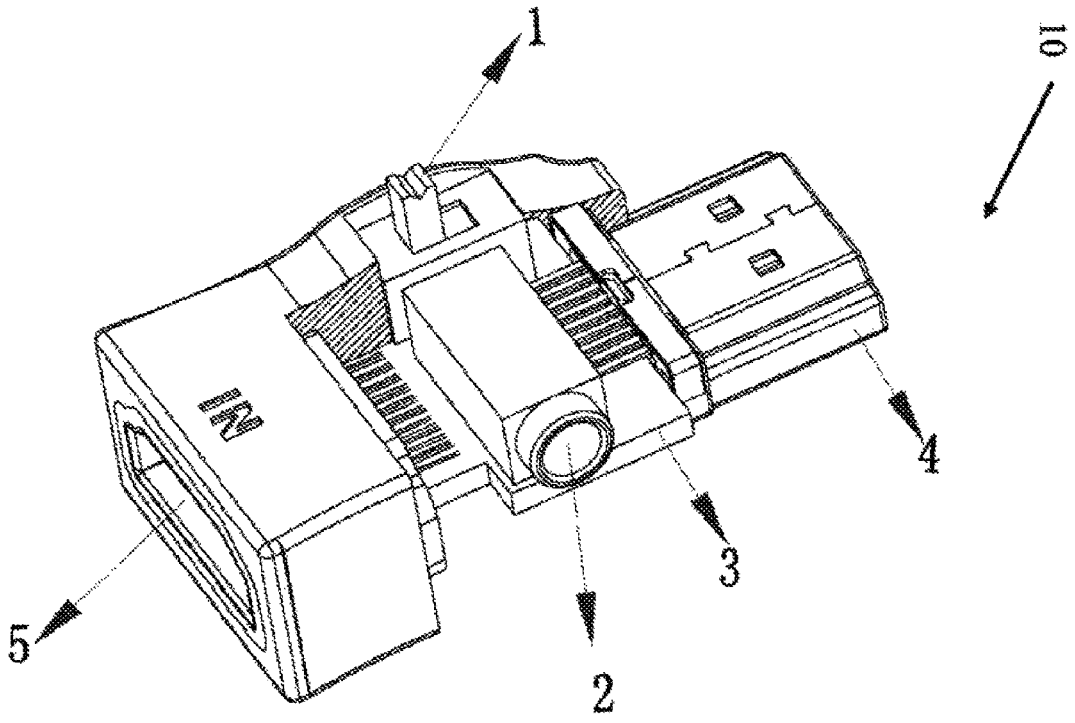
FIG. 1 is a structurally sectional view of a converter for switching control signals according to a preferred embodiment of the present invention.

Referring to FIG. 1 of the drawings, a converter 10 for switching control signals according to a preferred embodiment of the present invention is illustrated, comprising an interface male 4 connected with an equipment which is controlled by a first control signal; an interface socket 2 connected with an equipment which is controlled by a second control signal; an interface female 5 connected with cables which are adapted for transmitting the first control signal and the second control signal; a switch 1 which switches between the first control signal and the second control signal; and a substrate 3 connected with the interface male 4, the interface socket 2, the interface female 5 and the switch 1.

The substrate 3 has a switch function, that is to say, based on a switching position of the switch 1, the substrate 3 controls the first control signal or the second control signal, which is transmitted by the cables connected with the interface female 5, to correspondingly switch to the interface male 4 or the interface socket 2 for outputting.

It is worth to mention that: the connection mode shown in FIG. 1 is one of the converters 10 of the present invention, other connection modes are applicable, such as exchanging connection positions of the interface male 4 and the interface socket 2 on the substrate 3. One skilled in the art is capable of making a variety of modification based on FIG. 1, so other concrete modification modes are not further described here. However, it should be clear that these modifications are within the scope protected by the present invention.

Figure 2:
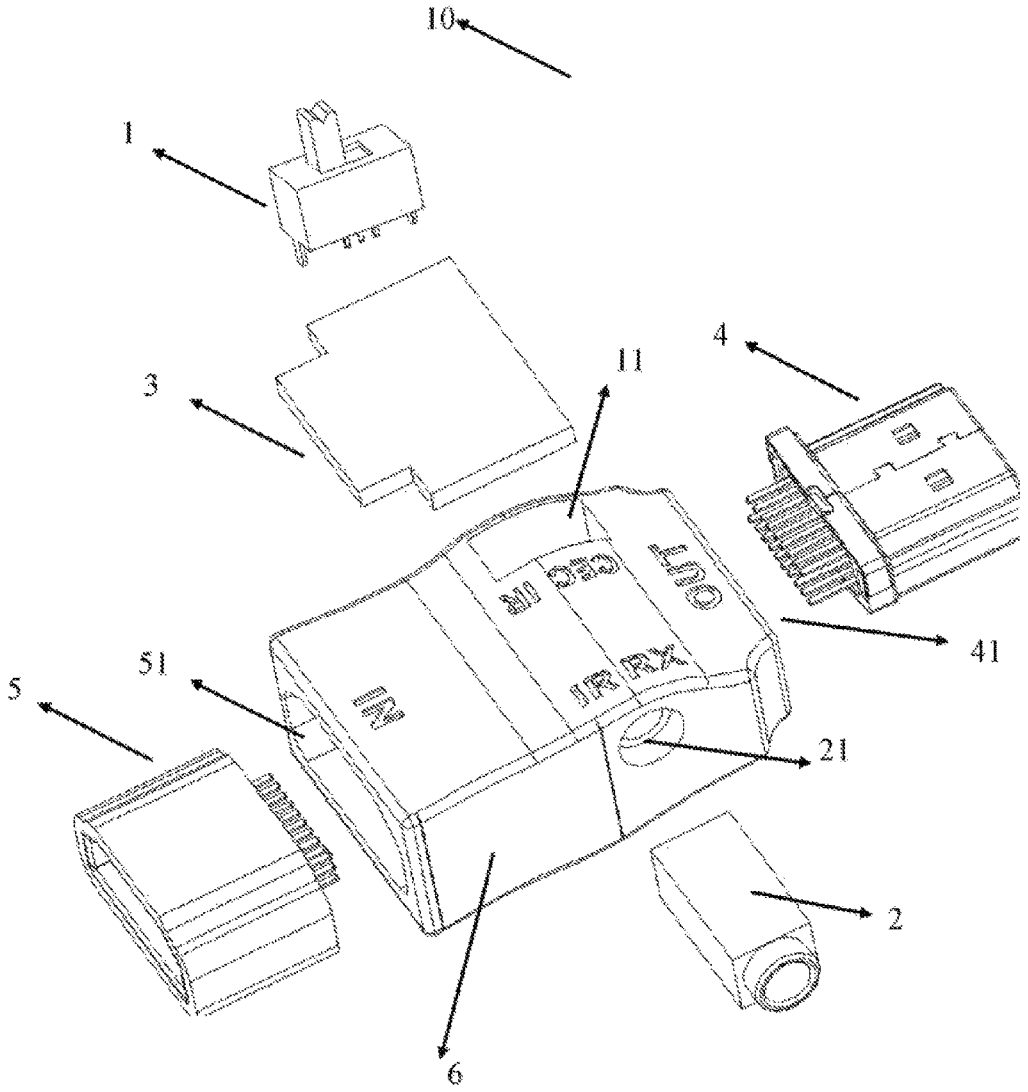
FIG. 2 is an exploded view of the converter for switching control signals according to the above preferred embodiment of the present invention.

As shown in FIG. 2, to protect the substrate 3 and the connections among the substrate 3, the interface male 4, the interface socket 2, the interface female 5 and the switch 1. The converter 10 further comprises a casing 6 enwrapped around the substrate 3.

More specifically, in this embodiment, the first control signal is embodied as a CEC signal; the second control signal is embodied as an infrared control signal; the cables are embodied as HDMI CABLEs to describe the converter 10.

Correspondingly, the interface male 4 connected with the equipment which is controlled by the first control signal is embodied as follows: the interface male 4 connected with the equipment which is controlled by the CEC signal; wherein the equipment which is controlled by the first control signal is able to be high definition televisions and blu-ray DVDs which support CEC signals.

The interface socket 2 connected with the equipment which is controlled by the second control signal is embodied as follows: the interface socket 2 for receiving and sending the infrared signal connected with the equipment which is controlled by the infrared control signal; wherein the equipment which is controlled by the second control signal is able to be common televisions, DVDs and air-conditionings.

The interface female 5 connected with the cables, which are respectively transmitting the first control signal and the second control signal, is embodied as: a HDMI interface female 5 connected with HDMI cables which are respectively transmitting the CEC signal and the infrared control signal.

As shown in FIG. 2, the converter 10 comprises the switch 1, the infrared receiving and sending socket 2, the HDMI male 4, the HDMI female 5, the substrate 3 and the casing 6.

The switch 1, the infrared receiving and sending socket 2, the HDMI male 4 and the HDMI female 5 are connected to the substrate 3, as shown in FIG. 1. Referring to FIG. 2, a male opening 41 corresponding to the HDMI male 4 is provided on the casing 6 which appropriately wraps around the substrate 3. Through the male opening 41, a portion of the HDMI male 4, which is connected with the equipment controlled by the CEC signal, is exposed. Furthermore, a socket opening 21 corresponding to the infrared receiving and sending socket 2 is also provided on the casing 6 which appropriately wraps around the substrate 3. Through the socket opening 21, the infrared receiving and sending socket 2 is connected with the equipment controlled by the infrared control signal. Furthermore, a female opening 51 corresponding to the HDMI female 5 is provided on the casing 6 which appropriately wraps around the substrate 3. Through the female opening 51, the HDMI female 5 is connected with the HDMI cables adapted for respectively transmitting the CEC signal and the infrared control signal.

Figure 3:
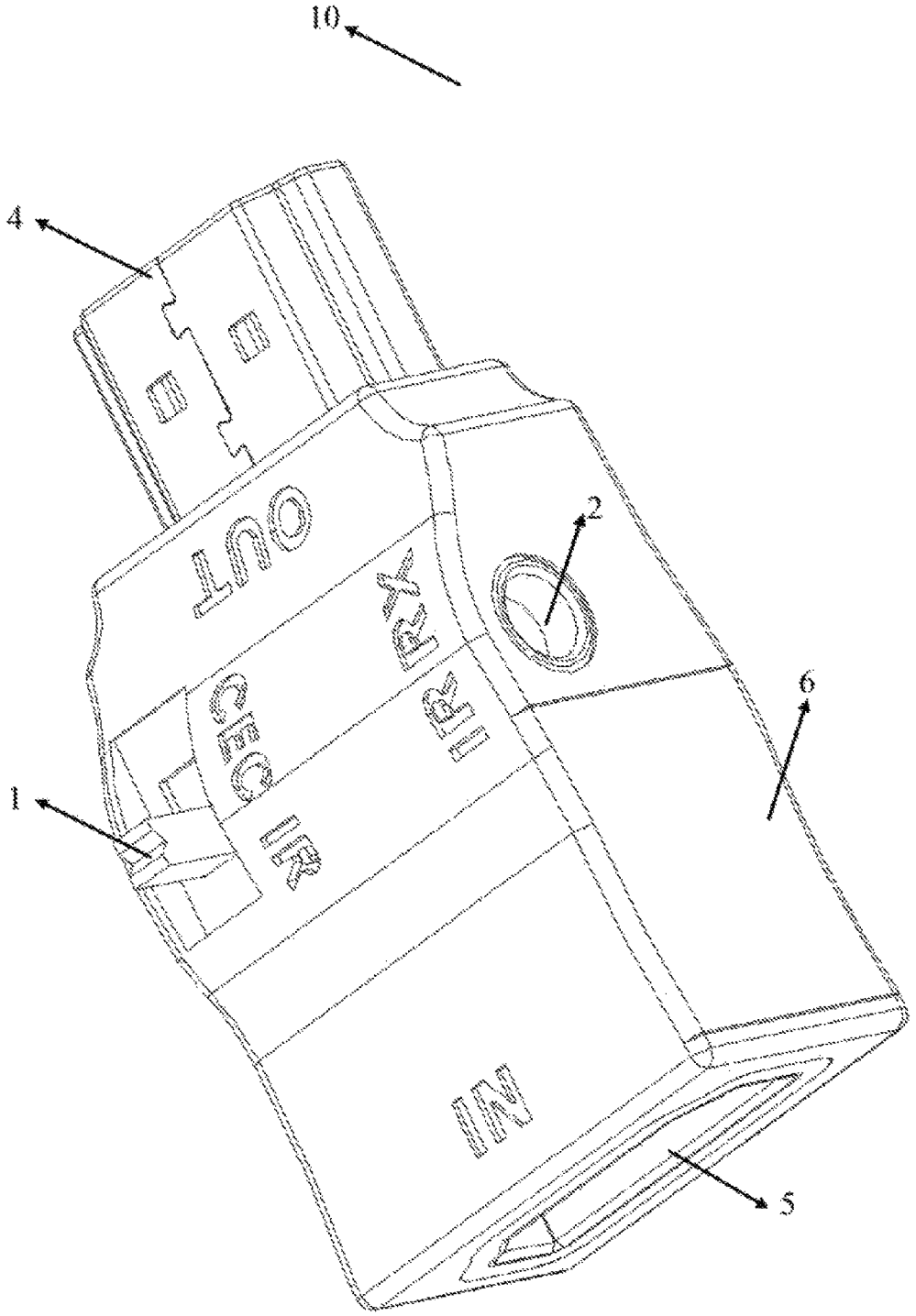
FIG. 3 is a three dimensionally structural view of the converter for switching control signals according to the above preferred embodiment of the present invention.
Figure 4:
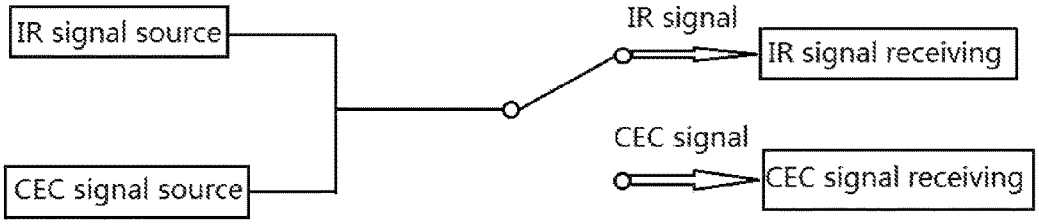
FIG. 4 is a principle diagram of the converter for switching control signals according to the above preferred embodiment of the present invention.

FIG. 3 shows the above structure and the three-dimensional structure of the converter 10. The HDMI male 4 of the converter 10 is connected with the equipment which is controlled by the CEC signal, the infrared receiving and sending socket 2 is connected with the equipment which is controlled by the infrared control signal, the HDMI female 5 is connected with the HDMI cables which are respectively adapted for transmitting the CEC signal and the infrared control signal. Accordingly, as shown in FIG. 4, when the HDMI cables transmit the infrared signal and the CEC signal, if a user switches the switch 1 to a position of "IR", the substrate 3 controls the output of the IR signal to remotely control long-range controlled equipments such as common TVs, DVDs and air conditionings; namely, the equipment, which is controlled by the infrared control signal, receives the IR signal; if a user switches the switch 1 to a position of "CEC", the CEC signal is outputted to the equipment with the "CEC" function, such as high definition televisions and blu-ray DVDs which support CEC signals.

Particularly, in the embodiment, the infrared receiving and sending socket 2 is capable of transmitting the received and/or sent infrared control signal; that is to say, the converter 10 in the embodiment is able to bidirectionally transmit and send the IR control signal. For example, the converter 10 is able to receive the IR control signal from the user and send the IR control signal, also receive the IR control signal from Internet and send the IR control signal.

The embodiment of the present invention is capable of expanding the converter for allowing the converter to switch between the CEC signal and the infrared control signal, thereby obtaining the technical effect that a converter is added without changing original settings of customer sides and cable sides to transmit and switch the CEC signal and the infrared control signal.

Figure 5:
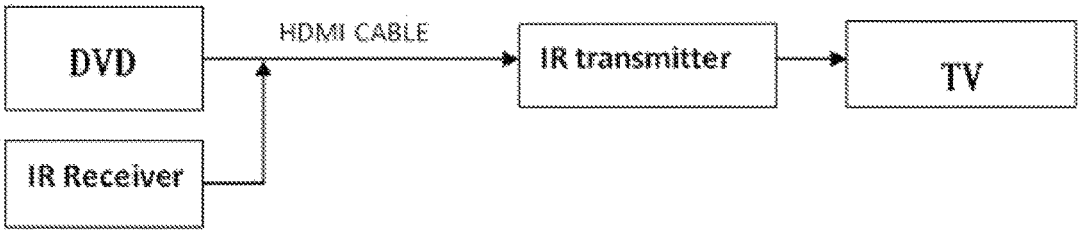
FIG. 5 shows that the converter for switching control signals of the present invention connects with a DVD and a TV, wherein "IR receiver" nears the DVD and "IR transmitter" nears the TV.
Figure 6:
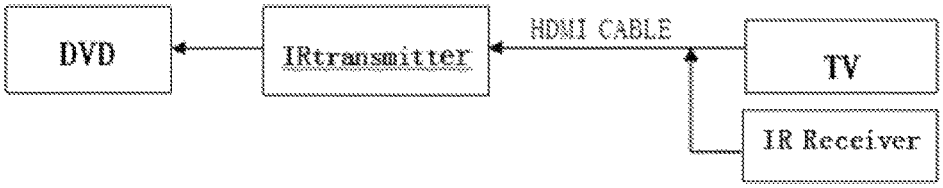
FIG. 6 shows that the converter for switching control signals of the present invention connects with a DVD and a TV, wherein "IR receiver" nears the TV and "IR transmitter" nears the DVD.

The working principle of the present invention is described as follows. Firstly, the IR (infrared) transmitter is inserted into the HDMI converter. Secondly, the IR receiver is inserted into the HDMI converter. Thirdly, the "IR transmitter" nears a controlled end, such as TV, namely, the "IR transmitter" is inserted into the HDMI interface of the TV, as shown in FIG. 5. On the contrary, if a DVD needs to be controlled, the "IR transmitter" is inserted into the HDMI interface of the DVD. Fourthly, the "IR receiver" nears a master end, if the DVD is controlled from the TV, the "IR receiver" is connected with the TV, the "IR transmitter" is connected with the DVD. On the contrary, if the TV is controlled from the DVD, the "IR receiver" is connected with the DVD, the "IR transmitter" is connected with the TV, as shown in FIG. 6.

The principle of infrared control is described as below.

(1) The sourced end is controlled by the display end. Firstly, referring to FIG. 6, the elements are connected with each other in sequence, wherein the "IR receiver" nears the TV, the "IR transmitter" nears the DVD, and the TV is connected with the IR transmitter via the HDMI cable. Secondly, open the TV and the DVD. Thirdly, a DVD remote controller aims at the IR receiver for remotely controlling the DVD at the source end. For example, while pressing "PAUSE" key or "START" key of the DVD, the TV is correspondingly controlled to pause or start.

(2) The TV is controlled by the source end.

Referring to FIG. 5, the elements are connected with each other in sequence, wherein the "IR receiver" nears the DVD, the "IR transmitter" nears the TV, and the DVD is connected with the IR transmitter via the HDMI cable. Secondly, open the TV and the DVD. Thirdly, the TV remote controller aims at the IR receiver at the DVD source end for remotely controlling the TV. For example, while pressing "POWER" key of the TV, namely, the TV is started while power-on and closed while power-off.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A converter for switching control signals, comprising:

an interface male connected with an equipment which is controlled by a first control signal;

an interface socket connected with an equipment which is controlled by a second signal;

an interface female connected with cables which are adapted for respectively transmitting the first control signal and the second control signal;

a switch which switches between the first control signal and the second control signal;

a substrate connected with the interface male, the interface socket, the interface female and the switch, wherein according to a switching position of the switch, the substrate controls the first control signal or the second control signal in the cables connected with the interface female to correspondingly switch to the interface male or the interface socket for outputting; and a casing wrapping around the substrate, wherein:

a male opening corresponding to the interface male is provided on the casing, a portion of the interface male, connected with the equipment which is controlled by the first control signal, is exposed by the male opening;

a switch opening corresponding to the switch is provided on the casing, a portion of the switch for a user to toggle is exposed by the switch opening;

a socket opening corresponding to the interface socket is provided on the casing and the interface socket is connected with the equipment which is controlled by the second control signal by the socket opening; and a female opening corresponding to the interface female is provided on the casing, the interface female is connected with the cables adapted for respectively transmitting the first control signal and the second control signal by the female opening.

2. The converter, as recited in claim 1, wherein:

the interface male, connected with the equipment which is controlled by the first control signal, is a HDMI (high definition multimedia interface) male connected with an equipment which is controlled by a CEC (consumer electronics control) signal;

the interface socket, connected with the equipment which is controlled by the second control signal, is an infrared receiving and sending socket connected with an equipment which is controlled by an infrared control signal; and the interface female, connected with the cables adapted for respectively transmitting the first control signal and the second control signal, is an HDMI female connected with HDMI cables adapted for respectively transmitting the CEC signal and the infrared control signal.

3. The converter, as recited in claim 2, wherein the infrared receiving and sending socket transmits the received and/or sent the infrared control signal.

* * * * *